US009526940B2

(12) United States Patent
Renk

(10) Patent No.: US 9,526,940 B2
(45) Date of Patent: Dec. 27, 2016

(54) MULTI-HANDLED WEIGHTED FITNESS DEVICE

(71) Applicant: Martin P Renk, Winona, MN (US)

(72) Inventor: Martin P Renk, Winona, MN (US)

( * ) Notice: Subject to any disclaimer, the term of this patent is extended or adjusted under 35 U.S.C. 154(b) by 0 days.

(21) Appl. No.: 14/146,318

(22) Filed: Jan. 2, 2014

(65) Prior Publication Data

US 2014/0187392 A1 Jul. 3, 2014

Related U.S. Application Data

(60) Provisional application No. 61/748,610, filed on Jan. 3, 2013.

(51) Int. Cl.

| | |
|---|---|
| ***A63B 21/062*** | (2006.01) |
| ***A63B 21/072*** | (2006.01) |
| ***A63B 21/075*** | (2006.01) |
| ***A63B 21/078*** | (2006.01) |

(52) U.S. Cl.

CPC ..... *A63B 21/0724* (2013.01); *A63B 21/072* (2013.01); *A63B 21/0726* (2013.01); *A63B 21/4035* (2015.10)

(58) Field of Classification Search

CPC ..... A63B 21/0004; A63B 21/00079; A63B 21/00094; A63B 21/00101; A63B 21/00116; A63B 21/0013; A63B 21/06; A63B 21/072; A63B 21/0722; A63B 21/0724; A63B 21/0726; A63B 21/0728; A63B 21/14; A63B 21/1453; A63B 21/1465; A63B 21/1469; A63B 21/148; A63B 21/1484; A63B 21/075; A63B 21/0786

USPC ..... D21/680–682

See application file for complete search history.

(56) References Cited

U.S. PATENT DOCUMENTS

| | | | | |
|---|---|---|---|---|
| 1,877,218 | A * | 9/1932 | Blank | 482/126 |
| 3,536,326 | A * | 10/1970 | Yatrides | A63B 21/0004 482/126 |
| 4,018,442 | A * | 4/1977 | Galler | 482/106 |
| 4,333,645 | A * | 6/1982 | Wu | A63B 21/00043 482/112 |
| 4,461,473 | A * | 7/1984 | Cole | 482/106 |
| 4,822,035 | A * | 4/1989 | Jennings et al. | 482/106 |
| 5,031,906 | A * | 7/1991 | Jang | A63B 21/0004 482/125 |
| 5,735,779 | A * | 4/1998 | Lay | 482/93 |
| 7,097,601 | B1 * | 8/2006 | Ronnow | 482/106 |
| 2010/0323854 | A1 * | 12/2010 | Brandenburg | 482/106 |

* cited by examiner

*Primary Examiner* — Loan H Thanh
*Assistant Examiner* — Nyca T Nguyen
(74) *Attorney, Agent, or Firm* — Geiser Law, PLLC; Greg N. Geiser

(57) ABSTRACT

A multi-handled weighted fitness device. The device is a free weight comprised of a rectangular frame connected by a pair of opposing Y-shaped weighted members. The rectangular frame is comprised of four cylindrical side members that can be variously gripped by a user. The size of the opposing Y-shaped weighted members can be varied to alter the weight of the device. A central connecting member is joined to a base stem of each of the opposing Y-shaped weighted members. A user can also optionally grip the central connecting member.

4 Claims, 2 Drawing Sheets

MULTI-HANDLED WEIGHTED FITNESS DEVICE

CROSS REFERENCE TO RELATED APPLICATIONS

This application claims the benefit of provisional patent application Ser. No. 61/748,610 filed 2013 Jan. 3 by the present inventor.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present invention relates to a weighted device for strength-building exercises.

BACKGROUND OF THE INVENTION

Free weights familiar in this field of invention, such as kettlebells, dumbbells, and straight bars combined with weighted plates, generally provide only a very limited number of gripping options for a user engaged in strength-building exercises. A user can benefit, however, from gripping the free weights in a variety of different ways while exercising. These grip changes allow a user to lift the free weights in different ways to exercise a wider variety of muscle groups. Additionally, most free weights that can be used without a straight bar do not allow the option of being used in combination with a straight bar.

SUMMARY OF THE INVENTION

In a free weight embodying the principles of the invention, a user can grip the free weight in a wide variety of different ways. Also, the free weight is designed to be attached, at the user's option, to an Olympic-sized barbell.

The free weight is comprised of a pair of opposing Y-shaped weighted members connected by opposed side members and a central connecting member forming a co-planar rectangular frame. The four sides being a first side member, a second side member, a third side member, and a fourth side member, in the same plane. The four side members being cylindrical, have substantially the same diameter. The first side member and the second side member, having the same length, oppose each other across the rectangular frame. The third side member and the fourth side member, having the same length, oppose each other across the rectangular frame. The four side members function as handles for use in gripping and lifting the free weight and define the perimeter of the rectangle exclusive of four corner joints.

A first Y-shaped weighted member has three stems, the three stems being a first stem, a second stem, and a third stem. The three stems radiate outward from a central point on the first Y-shaped weighted member. The first stem forming a base of the Y, and the second stem and the third stem forming together an upper V-shaped element of the Y and forming the corners of device.

The first stem of the first Y-shaped weighted member is positioned equidistant between the third side member and the fourth side member, projecting perpendicularly away from the first side member and toward the second side member. The first stem has a first distal end opposite the first side member.

The second stem of the first Y-shaped weighted member projects away from the central point of the first Y-shaped weighted member culminating to form a first corner joint connecting the first side member and the third side member. The third stem projects away from the central point of the first Y-shaped weighted member culminating to form a fourth corner joint connecting the first side member and the fourth side member.

A second Y-shaped weighted member has a mirror image structure of the first Y-shaped weighted member, having three stems, the three stems being a first stem, a second stem, and a third stem, the stems radiating outward from a central point of the second Y-shaped weighted member. The first stem forming a base of the Y, and the second stem and the third stem forming together an upper V-shaped element of the Y and forming the corners of device.

The second first stem of the second Y-shaped weighted member is positioned equidistant between the third side member and the fourth side member, projecting perpendicularly away from the second side member and toward the first side member. The second first stem has a distal end opposite the second side member.

The second stem of the second weighted member projects away from the central point of the second Y-shaped weighted member culminating to form a second corner joint connecting the second side member and the third side member. The third stem projects away from the central point of the second Y-shaped member culminating to form a third corner joint connecting the second side member and the fourth side member.

Preferably, the side members are received by boreholes in the corner joints sized to tightly receive the side members.

The central connecting member, having substantially the same diameter as the four side members, is centrally adjoined to both the first distal end and the second distal end of the opposing mirror-image Y-shaped weighted members, wherein the length of the central connecting member is selected to maintain the rectangular shape of the free weight. The central connecting member functions as a handle for use in gripping and lifting the free weight.

Preferably, the central connecting member is received by boreholes, sized to tightly receive the central connecting member, bored into the first distal end and the second distal end of the opposing mirror-image Y-shaped weighted members.

In the preferred embodiment shown, a circular aperture is placed near the central point of both Y-shaped weighted members. Ideally, the circular aperture has a diameter of two inches, allowing a user to slide the free weight onto an Olympic-sized barbell.

The Y-shaped weighted members can be varied in thickness to alter the overall mass of the free weight.

The free weight is designed to be a weighted exercise device so it is preferably constructed of a durable, heavy material such as steel. Although steel is preferred, other similar metals and other materials may be used to construct the free weight, including a combination of different materials for the Y-shaped weighted members, side members, and central connecting member. To improve comfort and grip, the side members and central connecting member may also be taped, coated, or wrapped with a rubber or a rubber-like material, or some other cushioned material such as foam.

Although several varying thicknesses and overall dimensions of the free weight device may be used, it is preferred that the length of the device be thirty (30) inches and the width of the device be nine (9) inches. The length and width being defined by the length of the side member plus the length of the pair of opposed corner joints connected to the side member. Further, it is preferred that the Y-shaped weighted members and have a thickness varying between one and one quarter (1.25) inches and two (2) inches.

BRIEF DESCRIPTION OF THE SEVERAL VIEWS OF THE DRAWINGS

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
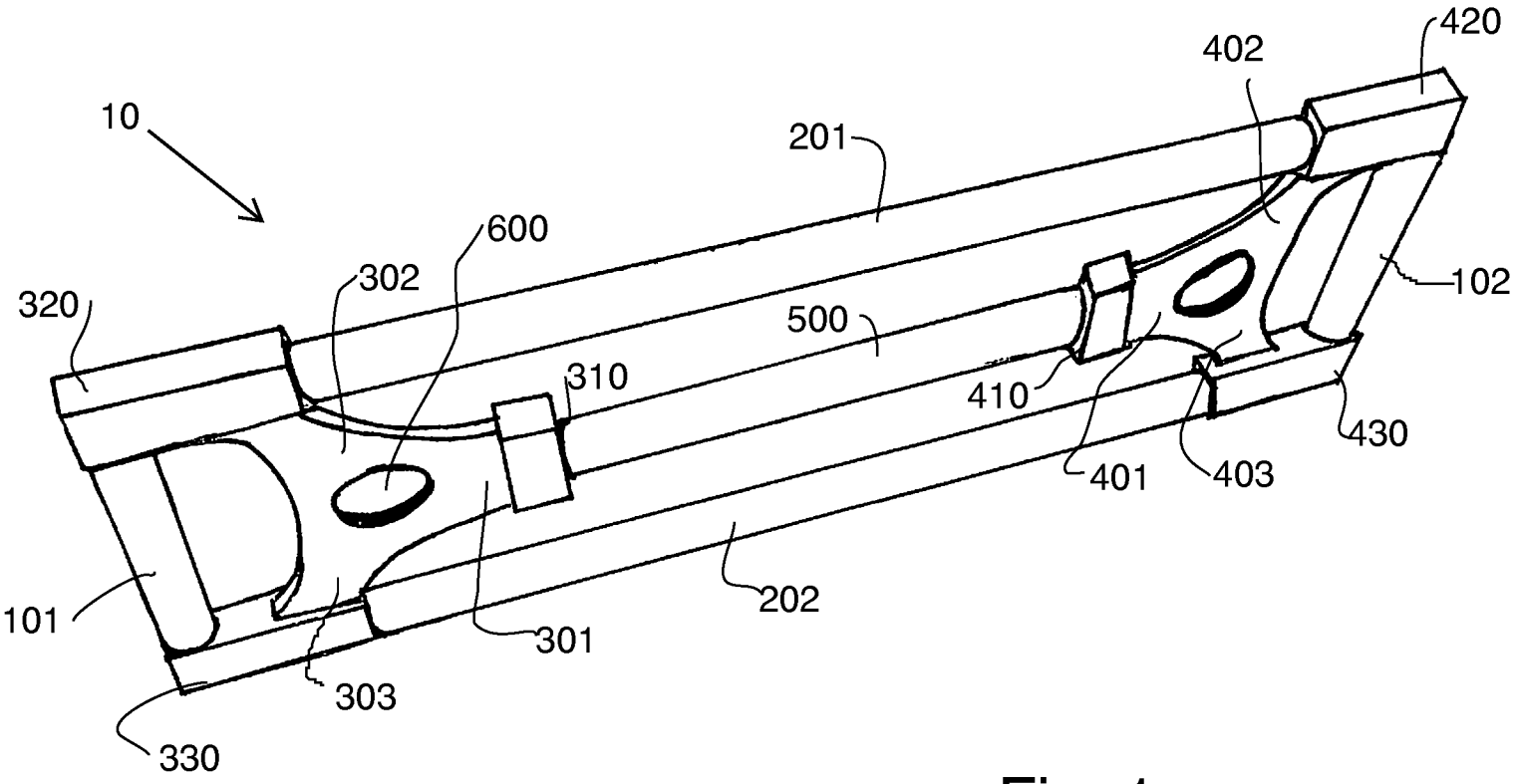
FIG. 1 is an isometric side view of the free weight, according to the present invention.
Figure 2:
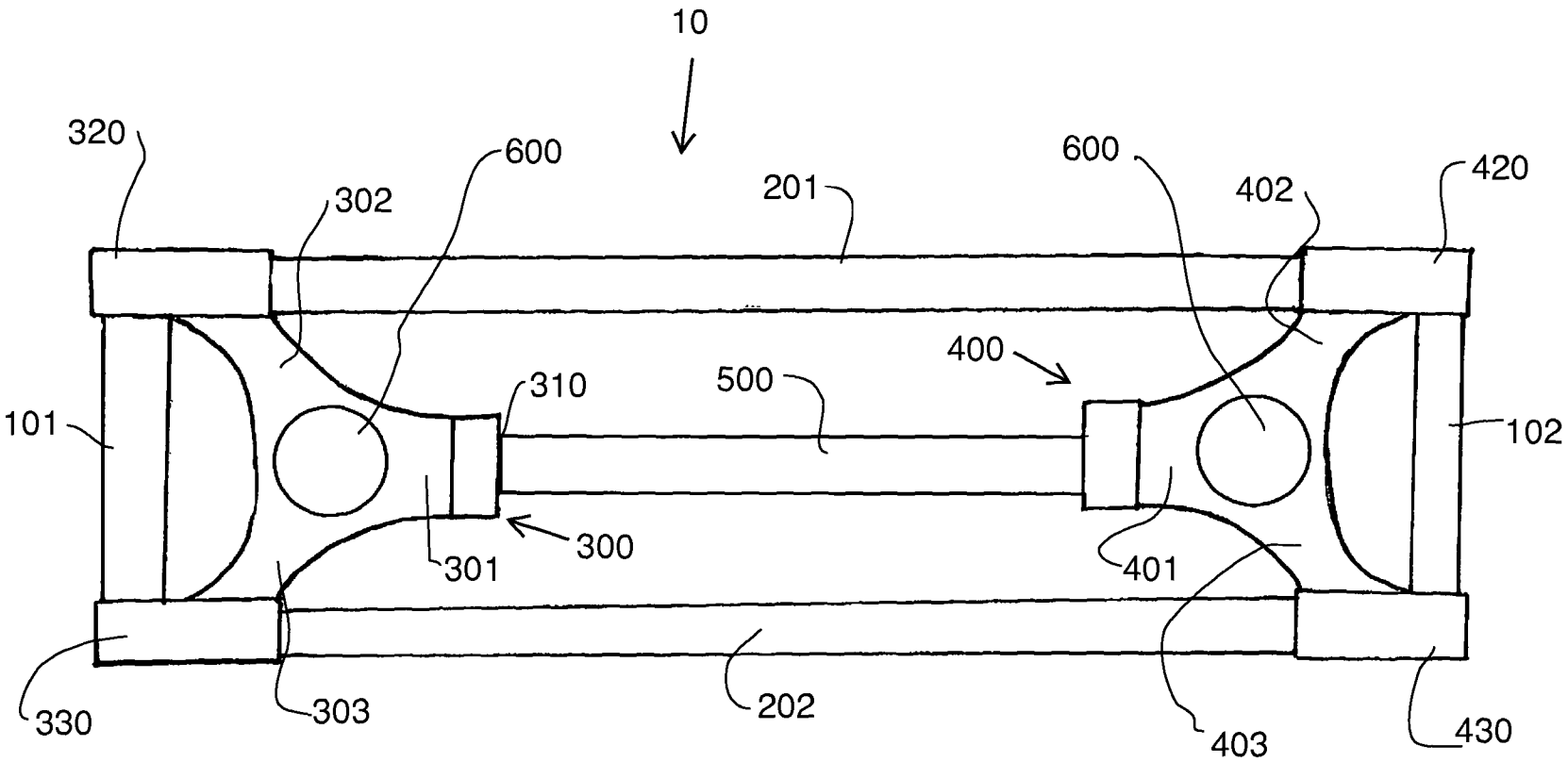
FIG. 2 is a top view of the free weight, according to the present invention.

Referring now to FIG. 1-2, a free weight is generally referred to as 10. The free weight 10 is comprised of a pair of opposing Y-shaped weighted members 300 and 400 connected by opposed side members 101, 102, 201, 202 and a central connecting member 500 and forming a co-planar rectangular frame. The four sides being a first side member 101, a second side member 102, a third side member 201, and a fourth side member 202, in the same plane. The four side members (101, 102, 201, and 202), being cylindrical, have substantially the same diameter. The first side member 101 and the second side member 102, having the same length, oppose each other across the rectangular frame. The third side member 201 and the fourth side member 202, having the same length, oppose each other across the rectangular frame. The four side members (101, 102, 201, and 202) function as handles for use in gripping and lifting the free weight 10 and define the perimeter of the rectangle exclusive of four corner joints.

A first Y-shaped weighted member 300, has three stems, the three stems being a first stem 301, a second stem 302, and a third stem 303. The three stems radiate outward from a central point on the first Y-shaped weighted member 300. The first stem 301 forming a base of the Y, and the second stem 302 and the third stem 303 forming together an upper V-shaped element of the Y and forming the corners of device 10.

The first stem 301 of the first Y-shaped weighted member 300 is positioned equidistant between the third side member 201 and the fourth side member 202, projecting perpendicularly away from the first side member 101 and toward the second side member 102. The first stem 301 has a first distal end 310 opposite the first side member 101.

The second stem 302 of the first Y-shaped weighted member 300 projects away from the central point of the first Y-shaped weighted member 300 culminating to form a first corner joint 320 connecting the first side member 101 and the third side member 201. The third stem 303 projects away from the central point of the first Y-shaped weighted member 300 culminating to form a fourth corner joint 330 connecting the first side member 101 and the fourth side member 202.

A second Y-shaped weighted member 400 has a mirror image structure of the first Y-shaped weighted member 300, having three stems, the three stems being a first stem 401, a second stem 402, and a third stem 403, the stems radiating outward from a central point of the second Y-shaped weighted member 400. The first stem 401 forming a base of the Y, and the second stem 402 and the third stem 403 forming together an upper V-shaped element of the Y and forming the corners of device 10.

The second first stem 401 of the second Y-shaped weighted member 400 is positioned equidistant between the third side member 201 and the fourth side member 202, projecting perpendicularly away from the second side member 102 and toward the first side member 101. The second first stem 401 has a distal end 410 opposite the second side member 102.

The second stem 402 of the second weighted member 400 projects away from the central point of the second Y-shaped weighted member 400 culminating to form a second corner joint 420 connecting the second side member 102 and the third side member 201. The third stem 403 projects away from the central point of the second Y-shaped member 400 culminating to form a third corner joint 430 connecting the second side member 102 and the fourth side member 202.

Preferably, the side members are received by boreholes in the corner joints (320, 330, 420, and 430) sized to tightly receive the side members (101, 102, 201, and 202).

The central connecting member 500, having substantially the same diameter as the four side members (101, 102, 201, and 202), is centrally adjoined to both the first distal end 310 and the second distal end 410 of the opposing mirror-image Y-shaped weighted members 300 and 400, wherein the length of the central connecting member 500 is selected to maintain the rectangular shape of the free weight 10. The central connecting member 500 functions as a handle for use in gripping and lifting the free weight 10.

Preferably, the central connecting member 500 is received by boreholes, sized to tightly receive the central connecting member 500, bored into the first distal end 310 and the second distal end 410 of the opposing mirror-image Y-shaped weighted members 300 and 400.

In the preferred embodiment shown, a circular aperture 600 is placed near the central point of both Y-shaped weighted members 300 and 400. Ideally, the circular aperture 600 has a diameter of two inches, allowing a user to slide the free weight 10 onto an Olympic-sized barbell.

The Y-shaped weighted members 300 and 400 can be varied in thickness to alter the overall mass of the free weight 10.

The free weight 10 is designed to be a weighted exercise device so it is preferably constructed of a durable, heavy material such as steel. Although steel is preferred, other similar metals and other materials may be used to construct the free weight 10, including a combination of different materials for the Y-shaped weighted members 300 and 400, side members (101, 102, 201, and 202), and connecting member 500. To improve comfort and grip, the side members (101, 102, 201, and 202) and central connecting member 500 may also be taped, coated, or wrapped with a rubber or a rubber-like material, or some other cushioned material such as foam.

Although several varying thicknesses and overall dimensions of the free weight device 10 may be used, it is preferred that the length of the device be thirty (30) inches and the width of the device be nine (9) inches. The length and width being defined by the length of the side member plus the length of the pair of opposed corner joints connected to the side member. Further, it is preferred that the Y-shaped weighted members 300 and 400 have a thickness varying between one and one quarter (1.25) inches and two (2) inches.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

What is claimed is:

1. A free weight device, the device comprising:

a pair of Y-shaped weighted members, each Y-shaped weighted member of the pair of Y-shaped weighted members having a stem portion, an upper-V portion, and being a mirror image of each other, each Y-shaped weighted member of the pair of Y-shaped weighted members containing an aperture;

four side members, each side member of the four side members are cylindrical and having an identical diameter, each side member of the four side members attached co-planar to the upper-V portions of the Y-shaped weighted members and forming a rectangular shaped periphery of the device; and a central connecting member, the central connecting member is cylindrical and having a diameter, the diameter identical to the diameter of the four side members, the central connecting member connecting each Y-shaped member of the pair of Y-shaped members at the stem portion.

2. The device as in claim 1, wherein the four side members and the central connecting member each have a gripping surface.

3. A free weight device, the free weight device having a rectangular shaped periphery and comprising:

a pair of Y-shaped weighted members, each Y-shaped weighted member of the pair of Y-shaped weighted members being a mirror image of each other, each Y-shaped member having a stem portion and an upper-V portion, each of the upper-V portions forming four corners of the rectangular shaped periphery;

a first pair of side members, the first pair of side members are cylindrical and having a diameter, each side member of the first pair of side members attached co-planar to the opposed upper-V portions of the Y-shaped weighted members and forming two sides of the rectangular shaped periphery of the device;

a second pair of side members, the second pair of side members are cylindrical and having a diameter identical to the diameter of the first pair of side members, each side member of the second pair of side members attached co-planar to the upper-V portions of the Y-shaped weighted members and connected to the upper-V portion of the same Y-shaped weighted member and forming two sides of the rectangular shaped periphery of the device; and a central connecting member, the central connecting member cylindrical and having a diameter identical to the first pair of side members and the second pair of side members, the central connecting member connecting each of the Y-shaped members at the stem portion.

4. The device as in claim 3, wherein the first pair of side members, the second pair of side members, and the central connecting member each have a gripping surface.

* * * * *